United States Patent [19]

Nijman

[11] 4,159,156

[45] Jun. 26, 1979

[54] CRIMPED, INSULATION-PIERCE ELECTRICAL CONNECTION AND METHOD AND APPARATUS FOR MAKING THE CONNECTION

[75] Inventor: John P. Nijman, West Hill, Canada

[73] Assignee: Bunker Ramo Corporation, Oak Brook, Ill.

[21] Appl. No.: 875,856

[22] Filed: Feb. 7, 1978

Related U.S. Application Data

[63] Continuation of Ser. No. 730,637, Oct. 7, 1976, abandoned.

[51] Int. Cl.[2] ..... H01R 13/38

[52] U.S. Cl. ..... 339/97 C

[58] Field of Search ..... 339/97–99, 339/223

[56] References Cited

U.S. PATENT DOCUMENTS

| | | | |
|---|---|---|---|
| 2,873,434 | 2/1959 | Drum et al. | 339/97 C |
| 3,145,261 | 8/1964 | Forney, Jr. | 339/98 |
| 3,902,154 | 8/1975 | McKee | 339/223 R |

*Primary Examiner*—Joseph H. McGlynn
*Attorney, Agent, or Firm*—William Lohff; F. M. Arbuckle

[57] ABSTRACT

An insulated conductor is terminated in an insulation-opening portion of an electrical contact and the contact jaws are crimped over the conductor to secure the conductor therein. A tool includes a pair of cutting edges and crimping surfaces for cutting and folding over sections of the contact jaws as the tool presses an insulated conductor into an insulation-opening notch formed by the contact jaws. The tool includes a forward end having a surface for engaging and pressing the conductor into the notch, the surface acting against the conductor as a stop to limit the depth of cut of the cutting edges. The tool may also be used after conductor insertion by other techniques to perform the crimping operation. The side surfaces of the tool slidingly engage the cut edges of the contact jaws and prevent an inward movement of the jaws during cutting and crimping. The resulting electrical connection is mechanically secure in that a normally open conductor-receiving channel is closed by the peeled over sections of the contact jaws thereby preventing outward movement of the conductor. The contact structure is of particular advantage where stranded wire is used in that the clamping action of the peeled over sections prevents relaxation distortions of the conductor which has become distorted during insertion and thus prevents pressure drop at the contact jaws which can result from relaxation distortion.

7 Claims, 4 Drawing Figures

Fig. 1
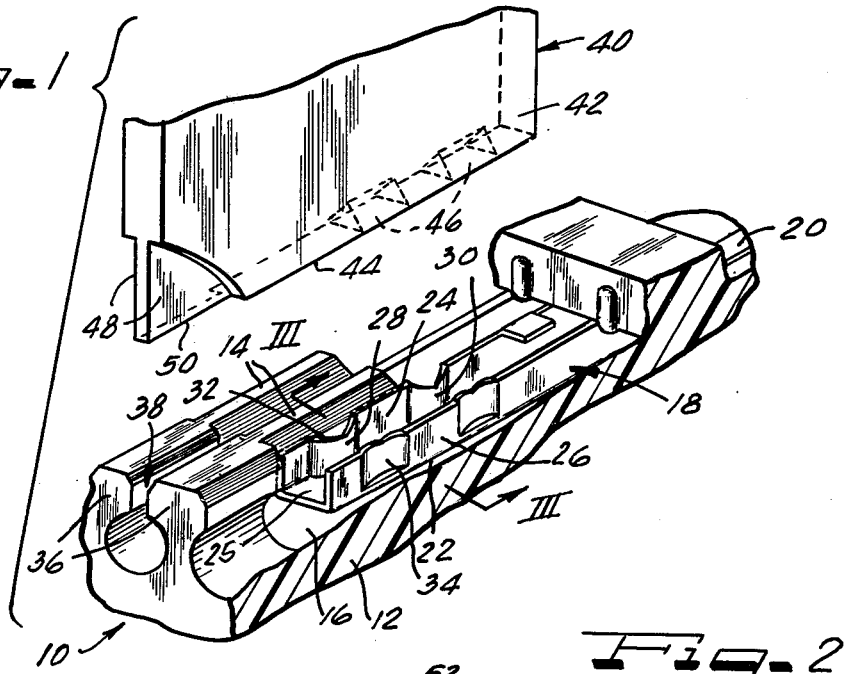
Fig. 2
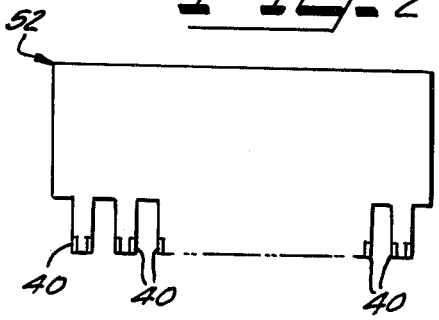
Fig. 3
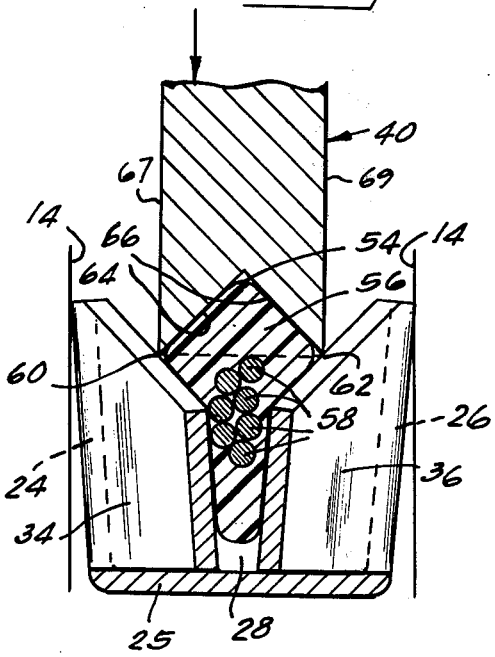
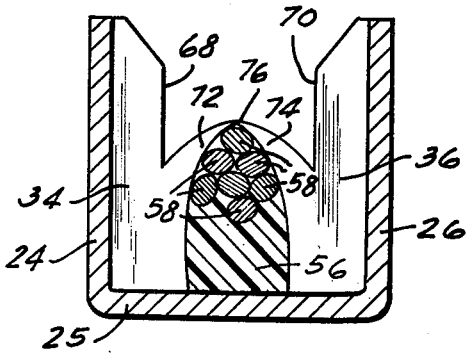
Fig. 4

CRIMPED, INSULATION-PIERCE ELECTRICAL CONNECTION AND METHOD AND APPARATUS FOR MAKING THE CONNECTION

This is a continuation of application Ser. No. 730,637, filed Oct. 7, 1976, now abandoned.

BACKGROUND OF THE INVENTION

1. Field of the Invention

This invention relates to solderless electrical connections, and is particularly concerned with insulation-opening electrical connections and a method and apparatus for making a crimped, insulation-opening electrical connection.

2. Description of the Prior Art

The prior art generally recognizes many types of crimped electrical connections. For example, a contact lug may be provided with a sleeve-type connecting portion in which one section is folded tightly about a stripped end of a conductor, while another section is folded tightly about the insulation adjacent the stripped end. Apparatus for accomplishing this crimping operation generally includes a pair of dies and apparatus for moving at least one of the dies toward the other to squeeze the appropriate contact portions therebetween.

It is generally well known in the art to press an insulated conductor, either solid wire or stranded wire, into an insulation-opening notch of a terminating portion of an electrical contact. One such contact is disclosed by Paul Hoppe Jr. in U.S. Pat. No. 3,867,005 as comprising a pair of insulation-piercing notches, each of which is formed by a pair of inwardly extending detents in parallel side walls of a U-shaped portion of an electrical contact. In his U.S. patent application Ser. No. 482,457, issued June 1, 1976 as U.S. Pat. No. 3,959,868, Istvan Mathe discloses a hand tool for inserting an insulated conductor into an insulation-opening contact of the type disclosed in U.S. Pat. No. 3,867,005. Inasmuch as it sometimes is desirable to insert and terminate a plurality of insulated conductors at the same time, the insertion blade is provided in multiple as disclosed by Nijman et al in their United States patent application Ser. No. 432,484, filed Jan. 11, 1974.

The term "insulation-opening" as used herein is meant to encompass all techniques in which the insulation covering a core of solid or stranded wire is cut, pierced pressed, broken or torn open by one or more elements to gain access and electrical contact to the core.

Although the insulation-opening techniques provide a good electrical and mechanical connection, it has been found that in certain instances, a loosening effect of the connection may occur. This is particularly a problem with stranded conductors which undergo distortion during insertion and which have a clamping pressure applied thereto by the insulation-opening contact elements. The subsequent application of tensile forces, axially and/or transversely, to the conductors held by such pressure causes a relaxation type of deformation and strand movement and repositioning so as to effect a drop in connection pressure. Of course, this condition is highly undesirable and should be eliminated.

SUMMARY OF THE INVENTION

It is therefore the primary object of the invention to provide a new and improved electrical connection between an insulation-opening contact portion and an insulated conductor in which the conductor is mechanically secured in the electrical contact.

A more specific object of the invention is to provide an electrical connection in which the electrical conductor is mechanically secured by the insulation-opening contact jaws of an electrical contact.

Another object of the invention is to provide a method of making a crimped, insulation-opening electrical connection between an insulated conductor and an insulation-opening portion of an electrical contact.

Another object of the invention is to provide a tool for crimping an insulation-piercing contact portion, or at least a section thereof over an electrically terminated conductor.

Another object of the invention is to provide a tool for inserting an insulated conductor into an insulation-opening portion of an electrical contact and at the same time crimping sections of the insulation-opening contact jaws over the insulated conductor.

Although reference is made herein to a specific insulation-opening portion of an electrical contact, the invention is applicable to all insulation-opening contacts in which at least one portion of the contact extends to a point adjacent the position of an inserted conductor. Therefore, although crimping of a contact jaw is specifically disclosed herein, crimping of other contact portions, such as a flange-type contact portion, during or subsequent to the insertion operation can be accomplished with a tool adapted for a particular contact structure.

According to the invention, an electrical connection comprises an insulated conductor which includes at least one electrical conductor within an insulating jacket, an electrical contact including an insulation-opening portion and having a contact portion which extends through the insulation into electrical contact with the conductor, and a section of the contact portion folded over the insulated conductor to clamp the conductor against either another portion of the contact or against a contact supporting structure. Usually, the insulation-piercing portion will include a pair of second wall portions extending from the first wall portion in a U-shaped configuration on opposite sides of the insulated conductor, and each of the second wall portions will include a section folded over the insulated conductor toward the other section to clamp the insulated conductor between the first and second wall portions.

In a method of terminating an insulated conductor in an insulation-opening contact portion in which the insulated conductor is pressed into an insulation-opening notch formed by at least one insulation-piercing contact jaw extending at an angle to a supporting member which is either a portion of the contact, a dielectric contact support or the like, a specific improvement comprises the step of crimping a section of the contact jaw over the conductor to clamp the conductor against the supporting member and, consequently completely or at least substantially close the insulation-opening notch. In performing the crimping step, the attendant steps of cutting a section of contact jaw and folding the cut section over the conductor are accomplished. The cutting of the contact jaw can be thought of as peeling a section of the contact jaw and the step of folding the section over the conductor may be performed contemporaneously during peeling. In addition, the crimping step may advantageously be peformed simultaneously with the step of inserting the conductor into the insulation-opening notch.

A tool for inserting an insulated conductor into an insulation-opening portion of an electrical contact which has an outwardly open notch for receiving the conductor transversely of the axis of the conductor and a roll portion adjacent the notch, comprises a conductor insertion member for engaging and pressing an insulated conductor into the notch, and a crimping means are connected to the insertion member for engaging and crimping a section of the roll portion over the conductor and close at least a portion of the notch, the insertion member including a forward end for engaging the conductor and the crimping means comprising a cutting edge on the forward end to cut a section of the wall portion and an oblique surface extending from the cutting edge for guiding and folding the cut section over the conductor. A tool for securing a conductor already inserted in such a contact may advantageously have the same structure and, in either case, the insertion member is in the form of a blade which has an end surface which engages the insulated conductor and which, when the insulated conductor is completely inserted, acts as a stop to limit the depth of cut.

BRIEF DESCRIPTION OF THE DRAWINGS

Other objects, features and advantages of the invention, its organization, construction and operation will be best understood from the following detailed description, taken in conjunction with the accompanying drawing, on which:

FIG. 1 is an enlarged view of a portion of an electrical contact supported by a dielectric insert with an insertion tool, constructed in accordance with the invention, poised as the same would be to accomplish an insertion and termination operation;

FIG. 2 is a plan view of a plurality of insertion blades carried on a common support, as would be employed in a machine for performing simultaneous insertions of a plurality of insulated conductors;

FIG. 3 is a sectional view taken substantially along the line III—III of FIG. 1 with an insertion blade in a position approximately at the time of initiation of insertion; and FIG. 4 is a sectional view, taken substantially along the line III—III of FIG. 1 illustrating the condition of the electrical contact after completion of an insertion and crimping operation.

DESCRIPTION OF THE PREFERRED EMBODIMENTS

Referring to FIG. 1, a portion of an electrical connector is generally illustrated at 10 as comprising a dielectric insert 12 having a plurality of parallel barriers 14 extending therefrom, the barriers 14 generally defining slots therebetween. The dielectric insert 12 includes a surface 16 between the barriers 14 which at least partially supports an electrical conductor 18.

The electrical conductor 18 includes an active portion 20 which is not illustrated in detail but which may be in the form of a male contact, female contact any similar type of mating, or lug contact. The electrical contact 18 also includes a U-shaped terminating portion 22 having a pair of side walls 24 and 26 which extend from a bottom wall 25. Detents in the side walls 24 and 26 define a pair of insulation piercing notches 28 and 30. Each of the notches are defined, at least in part, but a wall portion 32 and a wall portion 34. Although a specific type of insulation-piercing notch is disclosed herein, any of the insulation-piercing structures set forth in the above-identified patents or structures similar thereto may be utilized in practicing the invention, as will become evident from the following description.

At what is generally termed the "rear" of an electrical connector, the barriers 14 develop into different shapes and dimensions so as to form between a pair of wider portions 36 a constricted strain relief 38.

As generally disclosed above, an insulated conductor is pressed into the U-shaped channel formed by the side walls 24 and 26 into the notches 28 and 30 whereupon the contact jaws open the insulation of an insulated conductor and electrically contact the conductor (conductors) therein. The same occurs in the case of the present invention in that an insertion blade 40 engages and presses an insulated conductor into the terminating portion of the electrical contact to effect a similar electrical connection. The present invention, however, goes a step further in that the conductor is not only gripped by the contact jaws and by the strain relief in that a portion of each contact jaw is peeled away and bent over the conductor so as to grip the same between that portion of the contact jaws and the bottom wall 25, at the same time closing the normally outwardly opening insulation-piercing notch.

In order to accomplish the electrical connection of the invention, the tool blade 40 is provided with a forward end 42 which has a generally planar forward surface 44 for engaging and pressing an insulated conductor into the insulation-piercing portion of the electrical contact 18. At positions aligned with the insulation-piercing notches 28 and 30, the blade 40 is provided with respective crimping means 46, which will be explained in greater detail below, which engage and crimp portions of the respective contact jaws over the insulated conductor.

In addition to the crimping means 46, the insertion blade 40 is provided with a pair of recesses 48 which define a strain relief insertion portion 50, aligned with the crimping means 46, for engaging and pressing a corresponding portion of an insulated conductor into the strain relief defined by the elements 36 and 38.

FIG. 2 illustrates a plurality of insertion blades 40 supportec by a common connecting and support members 52. This type of blade would be employed in an insertion tool of the type disclosed in the above mentioned Ser. No. 432,484.

Turning now to FIG. 3, an insertion tool, or more specifically an individual blade 40, is illustrated as the same is moved in the direction of the arrow to insert an insulated conductor into an insulation-piercing portion of an electrical contact. The conductor 54 illustrated includes insulation 56 which surrounds a stranded wire which comprises a plurality of conductors 58. Each of the crimping means is illustrated as comprising a first cutting edge 60, a second cutting edge 62 and a pair of intersecting surfaces 64 and 66 which are divergent toward and intersect the plane of the end surface 44 at the side surfaces of the blade 40. As illustrated in FIG. 3, the conductor 54 is undergoing a deformation as it is being forced between the contact jaws 34 and 36. This deformation becomes more apparent in FIG. 4 which illustrates the completion of termination.

The cutting edges 60 and 62 cut and peel away sections of the contact jaws 34 and 36 along respective cut edges 68 and 70, such sections being referenced to 72 and 74 in FIG. 4. The section 72 and 74, as the same are being peeled from the contact jaws 34 and 36 engage and are folded over by the surfaces 64 and 66, respectively so as to converge in an area indicated at 76. As such, the sections 72 and 74 are folded over the insulated conductor 54 to close the insulation-piercing notch and clamp the conductor between the contact jaws and the bottom wall 25 of the insulation-piercing portion 22 of the electrical contact 18.

During insertion, the contact may also undergo a deformation, after which the resiliency of the contact provides a gripping action on the conductor. In the specific structure illustrated, the side surfaces of the parallel barriers 14, schematically shown in FIG. 3, are engaged by the contact side walls 24 and 26 during conductor insertion to provide stabilization of the contact. Consequently, the tool blade 40 is stabilized during the cutting operation in that the side surfaces 67 and 69 slidingly engage and are guided by the cut edges 68 and 70 as such edges are generated. Accordingly, any structure for restricting or limiting the opening action of the notch will provide similar stability of the particular contact and tool. In addition, the side surfaces 67 and 69 engage the cut edges and prevent an inward deflection of the jaws.

As mentioned above, not only is a good electrical contact achieved, but an improved and effective mechanical clamping of the conductor to the terminal is effected. In addition to providing an upper capture of the conductor by the crimped jaws, the inner surface of the folded portion of the jaws provide an increase in contact surface area in engagement with the metallic strands as shown in FIG. 4.

Although I have described my invention by reference to particular illustrated embodiments thereof, many changes and modifications of the invention may become apparent to those skilled in the art without departing from the spirit and scope of the invention. I therefore intend to include within the patent warranted hereon all such changes and modifications as may reasonably and properly be included within the scope of any contribution to the art.

I claim:

1. An electrical connection comprising:

an insulated conductor including at least one electrical conductor and insulation surrounding said conductor, an electrical contact including an insulation-piercing portion, said insulation-piercing portion including a first wall portion and a pair of second wall portions integral with and extending at an angle from said first wall portion on opposite sides of said insulated conductor, each of said second wall portions extending through said insulation and in electrical contact with said conductor, and a pair of sections cut from respective ones of said second wall portions, each of said sections folded over said insulated conductor toward the other such section to contact said conductor, increase the contact area and clamp said conductor between said first and second wall portions of said cut sections.

2. An electrical connection comprising:

an insulated conductor including at least one electrical conductor and insulation surrounding said conductor, an electrical contact including a U-shaped channel, said U-shaped channel including a first wall portion and a second wall portion, a pair of inwardly extending contact elements carried by respective ones of said wall portions, said contact elements extending through said insulation and in electrical contact with said conductor, and means cut from and bent inwardly from each of said contact elements for contacting said conductor, increasing the contact area and clamping said conductor within said U-shaped channel.

3. An electrical connection comprising a stranded conductor, insulation covering said stranded conductor, and electrical contact means including a bottom wall and a pair of conductive walls extending parallel to each other and generally perpendicular to said bottom wall to form a conductor receiving channel with said insulated conductor therein, at least one of said conductive walls including an integral inwardly bowed contact portion extending therefrom through said insulation and into electrical contact with said stranded conductor, said contact portion including a section cut therefrom and folded over to electrically contact said stranded conductor on the side opposite said bottom wall to increase the contact area clamp said stranded conductor, said cut section extending across said channel a distance sufficient to prevent outward movement of said stranded conductor.

4. The electrical connection of claim 3, wherein:

each of said conductive walls includes a respective contact portion extending therefrom through said insulation and into electrical contact with said stranded conductor, and each of said contact portions includes a respective cut section extending across said channel to electrically contact said stranded conductor, each of said sections having an end which is substantially pointed and at substantially the same location as the like end of the other section to close that portion of the channel.

5. An electrical connection comprising:

an electrical contact including an elongate, generally U-shaped conductor receiving channel comprising a bottom wall and a pair of sidewalls extending from said bottom wall, an insulated conductor in said channel, said insulated conductor including a conductive core and insulation covering said core, a pair of inwardly dimpled contact jaws extending inwardly from and continuous with respective ones of said sidewalls in opposing relation into said channel and through said insulation and into electrical contact with said core, and a pair of projections cut from and extending toward each other from respective ones of said inwardly dimpled contact jaws to electrically contact said conductive core, increase the contact area and clamp the same between said projections and said contact jaws and said bottom wall.

6. An elongate electrical connection comprising:

an insulated conductor including at least one electrical conductor and insulation surrounding said conductor, an electrical contact including an insulation-opening portion, said insulation-opening portion including a wall portion extending through said insulation and in electrical contact with said conductor, and means cut from said wall portion and bent inwardly to electrically contact said conductor and increase the contact area of said wall portion.

7. An elongate electrical connection comprising:

an insulated conductor including at least one electrical conductor and insulation surrounding said conductor, an electrical contact including an insulation-opening portion, and a first wall portion adjacent said insulation-opening portion, said insulation-opening portion including a second wall portion extending through said insulation and in electrical contact with said conductor, and means cut from said second wall portion and bent inwardly over said conductor to electrically contact, increase the contact area and clamp said conductor between said first and second wall portions.

* * * * *